US011519625B2

(12) United States Patent
Alhilo

(10) Patent No.: US 11,519,625 B2
(45) Date of Patent: Dec. 6, 2022

(54) MANAGING TEMPERATURE OVERSHOOT

(71) Applicant: Emerson Electric Co., St. Louis, MO (US)

(72) Inventor: Esan A. Alhilo, Florissant, MO (US)

(73) Assignee: Emerson Electric Co., St. Louis, MO (US)

( * ) Notice: Subject to any disclaimer, the term of this patent is extended or adjusted under 35 U.S.C. 154(b) by 127 days.

(21) Appl. No.: 17/229,544

(22) Filed: Apr. 13, 2021

(65) Prior Publication Data

US 2022/0325912 A1 Oct. 13, 2022

(51) Int. Cl.

| | |
|---|---|
| ***F24F 11/80*** | (2018.01) |
| ***F24F 11/523*** | (2018.01) |
| ***F24F 11/61*** | (2018.01) |
| ***F24F 11/49*** | (2018.01) |

(52) U.S. Cl.

CPC ..... *F24F 11/49* (2018.01); *F24F 11/523* (2018.01); *F24F 11/61* (2018.01); *F24F 11/80* (2018.01)

(58) Field of Classification Search

CPC ..... F24F 11/80; F24F 11/61; F24F 11/523

See application file for complete search history.

(56) References Cited

U.S. PATENT DOCUMENTS

| | | | | |
|---|---|---|---|---|
| 4,410,132 | A | 10/1983 | Levine | |
| 4,615,380 | A | 10/1986 | Beckey | |
| 4,674,027 | A | 6/1987 | Beckey | |
| 5,415,346 | A | 5/1995 | Bishop | |
| 8,695,887 | B2 | 4/2014 | Helt et al. | |
| 9,494,955 | B2 | 11/2016 | Hess et al. | |
| 9,797,619 | B2 | 10/2017 | Aljabari et al. | |
| 10,612,795 | B2 * | 4/2020 | Gagne | F24H 1/52 |
| 2017/0332676 | A1 * | 11/2017 | Minvielle | G05D 23/1904 |
| 2021/0007410 | A1 * | 1/2021 | Nakano | A24F 40/57 |
| 2021/0007412 | A1 * | 1/2021 | Nakano | A24F 40/53 |
| 2022/0128419 | A1 * | 4/2022 | Byggmästar | G01K 3/10 |

* cited by examiner

*Primary Examiner* — Nelson J Nieves
*Assistant Examiner* — Meraj A Shaikh
(74) *Attorney, Agent, or Firm* — Harness, Dickey & Pierce, P.L.C.; Anthony G. Fussner

(57) ABSTRACT

Disclosed are exemplary embodiments of methods for managing temperature overshoot. In an exemplary embodiment, a method includes determining a temperature delta between two sensor temperatures reported for a space at predetermined time intervals; determining a temperature rate of change by dividing the temperature delta with a time period that elapsed between the two sensor temperatures; determining a compensation by multiplying the temperature delta and the temperature rate of change; determining a compensated temperature by adding the compensation to a sensor temperature reported for the space; and using a controller and the compensated temperature to control operation of a heating system for the space.

20 Claims, 13 Drawing Sheets

MANAGING TEMPERATURE OVERSHOOT

FIELD

The present disclosure relates to managing temperature overshoot.

BACKGROUND

This section provides background information related to the present disclosure which is not necessarily prior art.

Thermostats are installed in spaces for controlling heating, ventilation, and air conditioning (HVAC) systems. Generally, the thermostat is a regulating device that may be used to sense temperature of the space in which it is installed and thereafter perform actions so that the temperature of the space is maintained near a desired setpoint.

DRAWINGS

The drawings described herein are for illustrative purposes only of selected embodiments and not all possible implementations, and are not intended to limit the scope of the present disclosure.

DETAILED DESCRIPTION

Figure 1:
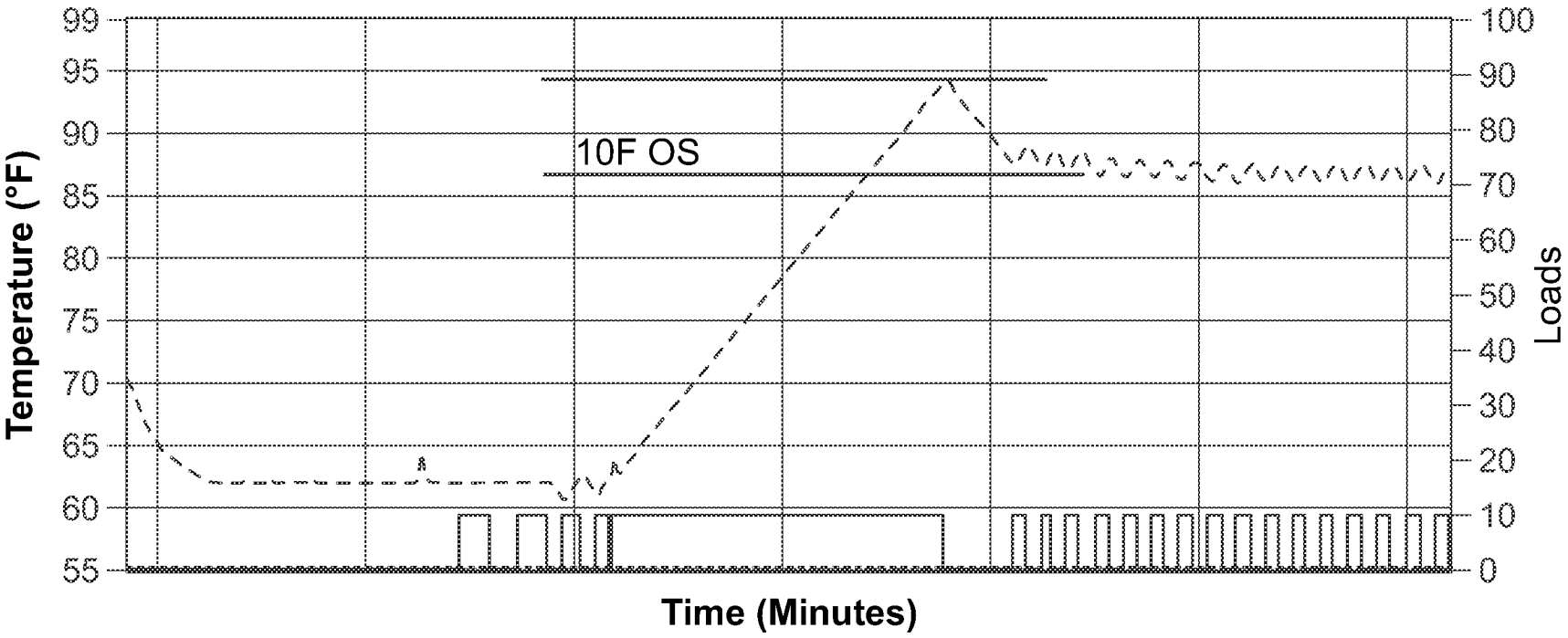
FIG. 1 is a line graph of temperature in degrees Fahrenheit (° F.) and first stage heat W1 loads versus time in minutes from NEMA (National Electrical Manufacturers Association) differential tests for a conventional thermostat.

Example embodiments will now be described more fully with reference to the accompanying drawings.

A thermostat may be installed in a space (e.g., space within a commercial building, etc.) for controlling an HVAC system capable of a relatively high rate of change in heating of the space. For example, the HVAC system may comprise an oversized HVAC system having a heating capability of 20° F. or greater per hour. The thermostat may include a thermistor within the thermostat enclosure or housing for reporting sensor temperature of the space. The thermistor inside the enclosure may have a thermal response considerably slower than the rate of change in heating capability (e.g., 20° F. or greater per hour, etc.) of the HVAC system. The thermistor's slower response to temperature change may cause the temperature of the space to overshoot the set temperature, e.g., by more than 5° F., etc. In which case, the high temperature overshoot will reduce HVAC system efficiency and increases energy usage.

Accordingly, disclosed herein are exemplary methods for managing temperature overshoot. In an exemplary embodiment, a method includes determining a temperature delta between two sensor temperatures reported for a space at predetermined time intervals; determining a temperature rate of change by dividing the temperature delta with a time period that elapsed between the two sensor temperatures; determining a compensation by multiplying the time delta and the temperature rate of change; determining a compensated temperature by adding the compensation to a sensor temperature reported for the space; and using a controller (e.g., a thermostat, etc.) and the compensated temperature to control operation of a heating system (e.g., HVAC system, etc.) for the space.

In an exemplary embodiment, the heating system comprises an HVAC system, and the controller comprises a thermostat. In which case, the method includes using the thermostat and the compensated temperature to control a heating mode of operation of the HVAC system. Also in this exemplary embodiment, the method may be initiated when: the HVAC system is in the heating mode of operation; the sensor temperature reported for the space is lower than a temperature setpoint of the thermostat; and the thermostat is calling for heat and first stage heat has been energized for at least a predetermined amount of time (e.g., a few minutes, etc.). In this example, the thermostat may include a thermistor (broadly, a temperature sensor) within a housing or enclosure of the thermostat. The thermistor of the thermostat may be used to obtain sensor temperature for the space at the predetermined time intervals.

In an exemplary embodiment, the method includes using a temperature sensor to obtain sensor temperature for the space at the predetermined time intervals. The temperature sensor may have a response to temperature change less than a rate of change in heating of the space by the heating system. For example, the temperature sensor may have a response less than 20° F. per hour.

In an exemplary embodiment, the method includes waiting a predetermined amount of time before determining a first temperature rate of change, and thereafter recalculating the temperature rate of change for the space after every sensor temperature measurement at the predetermined time intervals. The method may include waiting, for example, at least a few minutes before determining a first temperature rate of change, and thereafter recalculating the temperature rate of change for the space after every sensor temperature measurement, for example, every few seconds. Exemplary embodiments disclosed herein may be used with different time intervals, e.g., more or less than a few minutes, more or less than a few seconds, etc.

The method may include using the controller and the compensated temperature to control operation of the heating system for the space such that the temperature overshoot is 1° F. or less for any temperature rate of change in heating of the space by the heating system. For example, the method may include using the controller and the compensated temperature to control operation of the heating system for the space such that the temperature overshoot is 1° F. or less including when the heating system is heating the space at a temperature rate of change of at least a 20° F. per hour or more.

In an exemplary embodiment, the method includes using a thermostat and the compensated temperature to manage temperature overshoot via thermostat-based temperature-driven ramp-up compensation.

In an exemplary embodiment, the method includes using the controller and the compensated temperature to control a heating mode of operation of the heating system for ramp-up compensation.

In an exemplary embodiment, the method includes starting a timer and obtaining a first sensor reference temperature for the space when there is a call for heat and first stage heat is energized. The method also includes waiting a predetermined amount of a time while the first stage heat is energized and then obtaining a second sensor temperature for the space. The temperature delta is determined between the second sensor temperature that was recently obtained and the first sensor reference temperature that was obtained when the first stage heat was energized. For temperature ramp up, the temperature rate of change is determined by dividing the temperature delta with the time that has elapsed between when the first stage heat was energized and the first sensor reference temperature was obtained for the space and when the most recent second sensor temperature was obtained for the space.

In exemplary embodiments, the temperature delta is the difference between a first sensor reference temperature for the space when there is a call for heat and first stage heat is energized and a second sensor temperature for the space obtained a predetermined amount of a time while the first stage heat is energized. The temperature rate of change is the quotient of the temperature delta divided by a time period that elapsed between when the first stage heat was energized and the first sensor reference temperature was obtained for the space and when the most recent second sensor temperature was obtained for the space. The compensation is the product of the temperature delta and the temperature rate of change. The compensated temperature is the sum of the compensation and the most recent sensor temperature.

In an exemplary embodiment, the method includes providing a power up default value for the temperature rate of change (e.g., 20° F. per hour, etc.) upon power up of the heating system.

Also disclosed are exemplary embodiments of thermostats (e.g., 24 VAC thermostat, WiFi smart thermostat, other thermostat, etc.). In an exemplary embodiment, a thermostat is configured for controlling operation of an HVAC system. The thermostat includes a processor and a temperature sensor configured to operable for obtaining sensor temperature of a space in which the thermostat is installed. The processor is configured to: determine a temperature delta between two sensor temperatures from the temperature sensor for the space at predetermined time intervals; determine a temperature rate of change by dividing the temperature delta with a time period that elapsed between the two sensor temperatures; determine a compensation by multiplying the temperature delta and the temperature rate of change; and determine a compensated temperature by adding the compensation to a sensor temperature obtained from the temperature sensor for the space. The thermostat is configured to be operable for using the compensated temperature for controlling a heating mode of operation of the HVAC system such that the temperature overshoot is 5° F. or less.

In an exemplary embodiment, the thermostat may be configured to be operable for using the compensated temperature for controlling the heating mode of operation of the HVAC system such that the temperature overshoot is 1° F. or less including when the HVAC system is heating the space at a temperature rate of change of at least 20° F. per hour or more. The temperature delta is the difference between a first sensor reference temperature for the space when there is a call for heat and first stage heat is energized and a second sensor temperature for the space obtained a predetermined amount of a time while the first stage heat is energized. The temperature rate of change is the quotient of the temperature delta divided by a time period that elapsed between when the first stage heat was energized and the first sensor reference temperature was obtained for the space and when the most recent second sensor temperature was obtained for the space. The compensation is the product of the temperature delta and the temperature rate of change. The compensated temperature is the sum of the compensation and the most recent sensor temperature.

Also disclosed are exemplary thermostat-based temperature-driven compensation methods for managing temperature overshoot of a space when heated by an HVAC system. In an exemplary embodiment, the method includes: determining a temperature delta between two sensor temperatures reported for a space at predetermined time intervals; determining a temperature rate of change by dividing the temperature delta with a time period that elapsed between the two sensor temperatures; determining a compensation by multiplying the temperature delta and the temperature rate of change; determining a compensated temperature by adding the compensation to a sensor temperature reported for the space; and using a thermostat and the compensated temperature to control a heating mode of operation of the HVAC system such that the temperature overshoot is 5° F. or less.

In an exemplary embodiment, the method may include using the thermostat and the compensated temperature to control the heating mode of operation of the HVAC system such that the temperature overshoot is 1° F. or less including when the HVAC system is heating the space at a temperature rate of change of at least 20° F. per hour or more. The temperature delta is the difference between a first sensor reference temperature for the space when there is a call for heat and first stage heat is energized and a second sensor temperature for the space obtained a predetermined amount of a time while the first stage heat is energized. The temperature rate of change is the quotient of the temperature delta divided by a time period that elapsed between when the first stage heat was energized and the first sensor reference temperature was obtained for the space and when the most recent second sensor temperature was obtained for the space. The compensation is the product of the temperature delta and the temperature rate of change. The compensated temperature is the sum of the compensation and the most recent sensor temperature.

Exemplary embodiments may include a firmware algorithm (e.g., FIGS. 7A-7G, etc.) configured to use reported sensor temperature to predict actual room temperature and temperature rate of change, calculate the delta between the calculated room and sensor temperatures, and add the calculated delta to the sensor temperature for use in controlling the heating system. The algorithm may be activated when the following conditions occurs: the system mode is heat, the sensor temperature is lower than the setpoint, and the thermostat is calling for heat and the first stage heat has been energized for at least a predetermined amount of time. Exemplary embodiments may be configured to read the sensor temperature at predetermined time intervals, start the ramp-up timer counter, calculate the temperature delta=the difference between last and previous temperature readings, calculate the temperature rate of change=temperature delta/ ramp-up timer counter, calculate compensation=delta*temperature rate of change, add the compensation to sensor temperature, and use the compensated temperature to control the heating system.

If the thermostat is installed in a space for controlling an oversized system that is capable of a 20° F. or greater per hour rate of change in heating and cooling, exemplary embodiments disclosed herein may advantageously help to manage temperature overshoot to a maximum of 5° F. overshoot. A conventional thermostat may be ineffective at controlling a 20° F. degrees per hour ramp-up temperature rate of change or faster. Exemplary embodiments disclosed herein may be configured with temperature driven compensation, able to handle a ramp-up temperature rate of change higher than 20° F. degrees per hour, and able to adapt to a temperature rate of change with higher compensations. Exemplary temperature driven compensation methods disclosed herein may be used for ramp-up (not ramp down) compensation to thereby add a ramp-up rate performance enhancement for the ramp-up compensation. Exemplary embodiments disclosed herein may be used with single or multiple stage gas heat systems.

With reference now to the figures, FIG. 1 is a line graph of temperature in degrees Fahrenheit (° F.) and first stage heat W1 loads versus time in minutes from NEMA (National Electrical Manufacturers Association) differential tests of 20° F. increase per hour for a conventional thermostat. The conventional thermostat was configured to be operable in accordance with a conventional temperature control-overshoot method/algorithm and configured to single stage GAS1, W1 heat mode. FIG. 1 shows a thermostat overshoot of 10° F. for a schedule of 62° F. to 85° F. at a 20° F. per hour rate of change.

Figure 2:
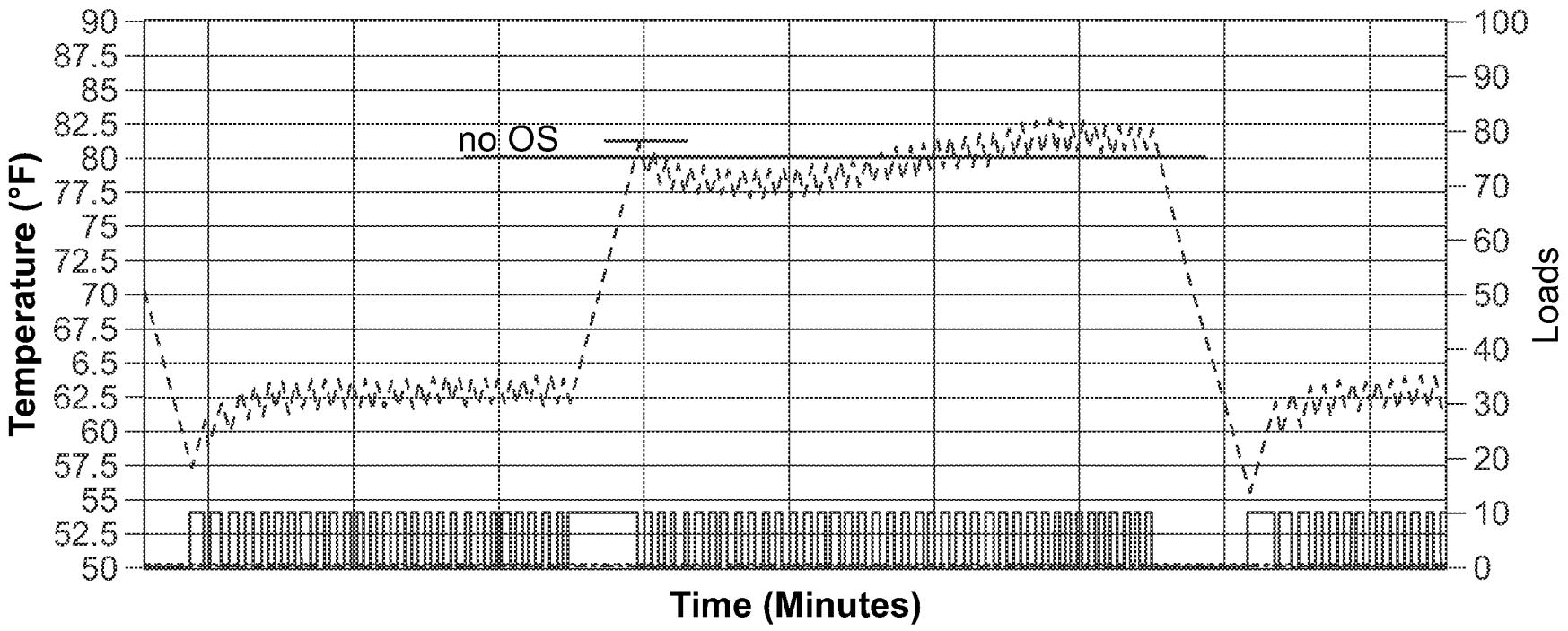
FIG. 2 is a line graph of temperature (° F.) and first stage heat W1 loads versus time (minutes) from NEMA differential tests for an exemplary embodiment of a thermostat configured to be operable for managing temperature overshoot as disclosed herein.

FIG. 2 is a line graph of temperature (° F.) and first stage heat W1 loads versus time (minutes) from a NEMA differential test of 20° F. increase per hour/20° F. decrease per hour from 60° F. to 80° F. for an exemplary embodiment of a thermostat (broadly, a controller) configured to be operable for managing temperature overshoot as disclosed herein. The thermostat was configured to single stage GAS1, W1 heat mode. FIG. 2 shows that the thermostat overshoot was about 0° F. or de minimis such that the thermostat did not overshoot in this example.

Generally, a comparison of the results shown in FIG. 1 for the conventional thermostat with the results shown in FIG. 2 show the considerable improvement achievable with an exemplary embodiment of a thermostat configured to be operable for managing temperature overshoot as disclosed herein. More specifically, FIG. shows an overshoot of 10° F. for the conventional thermostat. By comparison, FIG. 2 shows an overshoot of 0° F. for the exemplary embodiment of the thermostat configured to be operable for managing temperature overshoot as disclosed herein.

Figure 3:
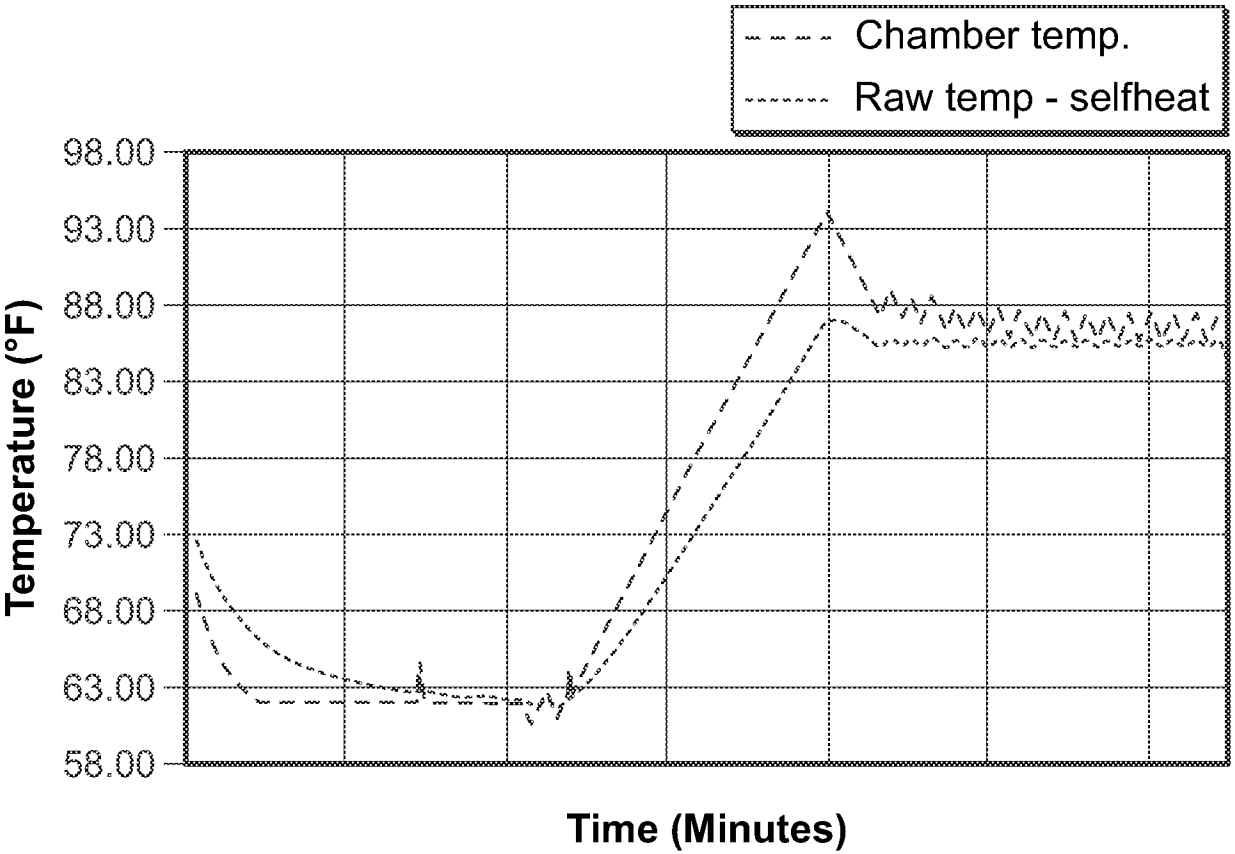
FIG. 3 is an exemplary line graph of chamber temperature and raw temperature (° F.) versus time (minutes) from a temperature sensor analysis.

FIG. 3 is an exemplary line graph of chamber temperature and raw temperature (° F.) versus time (minutes) from a temperature sensor analysis. Generally, FIG. 3 shows a hardware response lag of a thermistor within a thermostat enclosure. The thermistor response lag is proportionately correlated to the temperature rate of change of the chamber/space being heated by a thermostat-controlled HVAC system. As shown, the raw temperature reported from the thermistor lags the chamber temperature (the actual temperature of chamber/space in which thermostat is installed).

Figure 4:
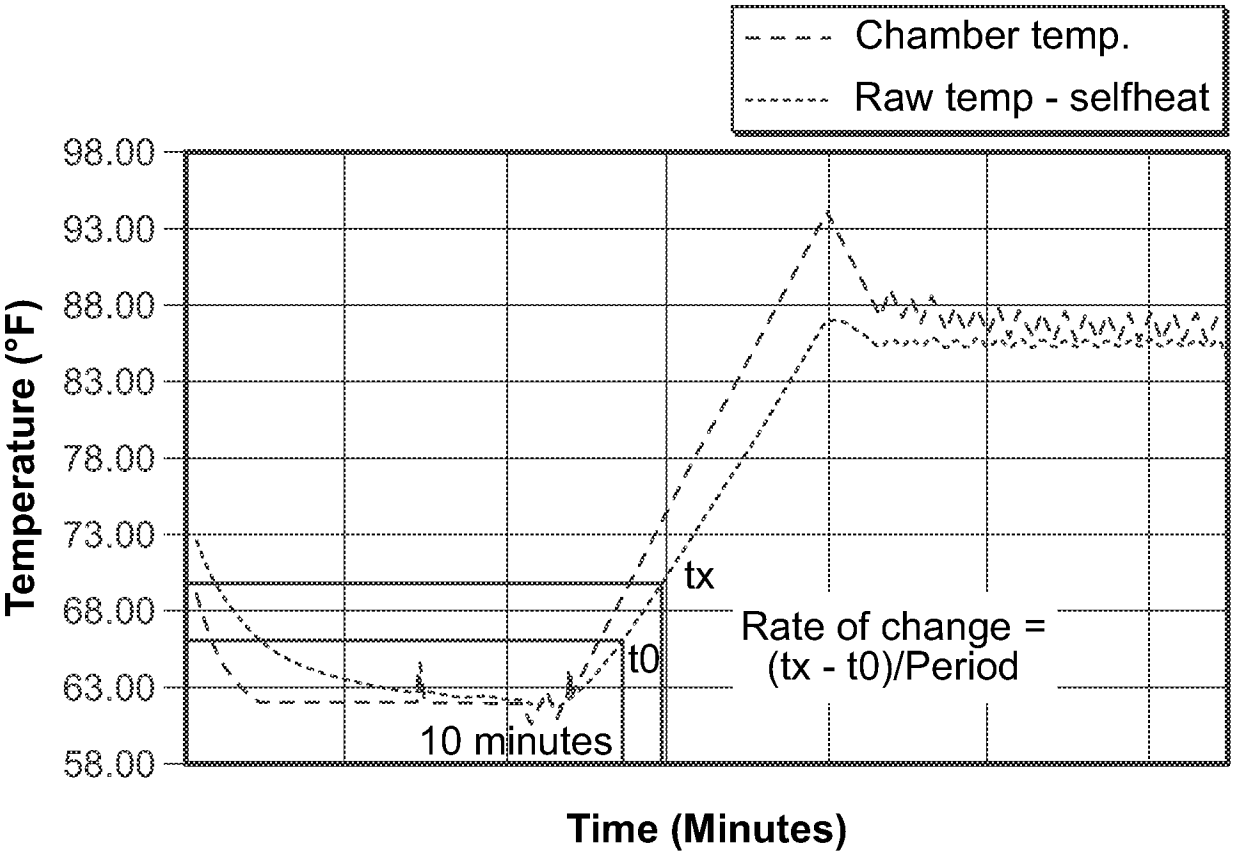
FIG. 4 is an exemplary line graph of chamber temperature and raw temperature (° F.) versus time (minutes), and showing temperature rate of change or ramp-up rate.

FIG. 4 is an exemplary line graph of chamber temperature and raw temperature (° F.) versus time (minutes) showing temperature rate of change or ramp-up rate. The temperature rate of change or ramp-up rate may be determined according to an exemplary method for managing temperature overshoot as disclosed herein. As shown in FIG. 4, this exemplary method may include determining or calculating a first temperature rate (Tx-T0/Period) of change after waiting a predetermined amount of time (e.g., a few minutes, other suitable time delay greater or less than a few minutes), e.g., after initiating or calling for a heating mode of operation, etc. This exemplary method may use a high number of samples or sensor temperature readings.

The temperature rate of change (Tx-T0/Period) is determined or calculated by subtracting a first or initial sensor temperature (T0) from the last or most recent sensor temperature (Tx), and then dividing that difference by the time period (Period) that elapsed between the first and last sensor temperature readings.

The temperature rate of change may be recalculated every few seconds (or other suitable time interval greater or less than a few seconds) after holding a predetermined amount of time (e.g., a few minutes, etc.), etc. A power up default value for the temperature rate of change (e.g., 20° F. per hour, etc.) may be provided upon power up of the heating system. The temperature rate of change is retained for the next period ramp-up. The temperature rate of change may be averaged among the following: instantaneous ramp-up rate of change, last period ramp-up rate of change, and others, such as wired or wireless remote temperature sensors rate of change.

Figure 5:
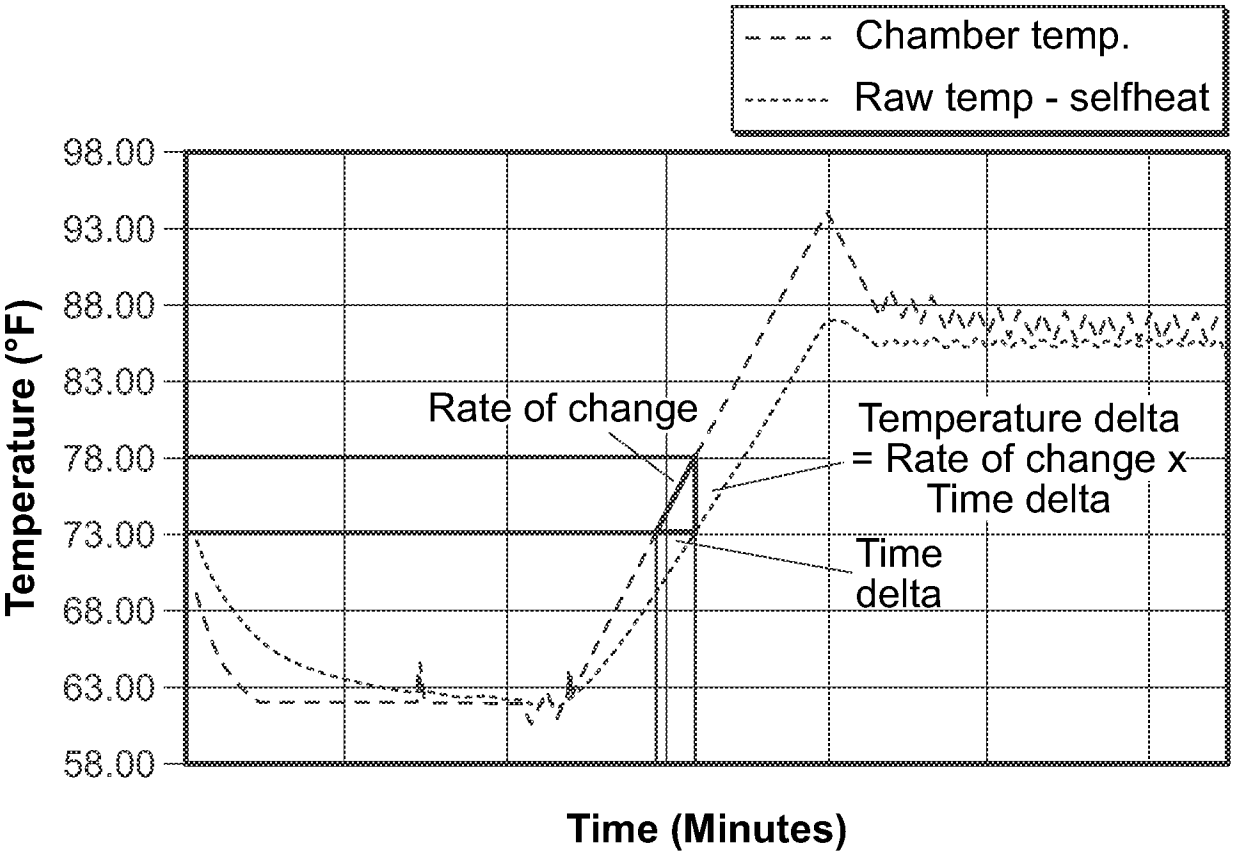
FIG. 5 is an exemplary line graph of chamber temperature and raw temperature (° F.) versus time (minutes), and showing hardware (thermistor) temperature lag compensation.

FIG. 5 is an exemplary line graph of chamber temperature and raw temperature (° F.) versus time (minutes) showing hardware (thermistor) temperature lag compensation, which may be determined while performing an exemplary method for managing temperature overshoot as disclosed herein. The exemplary method may include the following preconditions: system mode is heat, a call for heat and W1 is on, and temperature is less than the working setpoint.

The exemplary method may include predicting chamber temperature from a reported raw temperature from the temperature sensor (thermistor) and a raw temperature rate of change. Raw temperature delta may be determined or calculated by subtracting a hardware ramp-up reference value from a local temperature value. Chamber temperature rate of change may be determined or calculated by dividing the raw temperature delta by a hardware ramp-up time. Compensation may be determined or calculated by multiplying the raw temperature delta and the chamber temperature rate of change. The compensation may be added to the local temperature value/reported raw temperature from the temperature sensor to compensate for hardware thermal lag.

Figure 6:
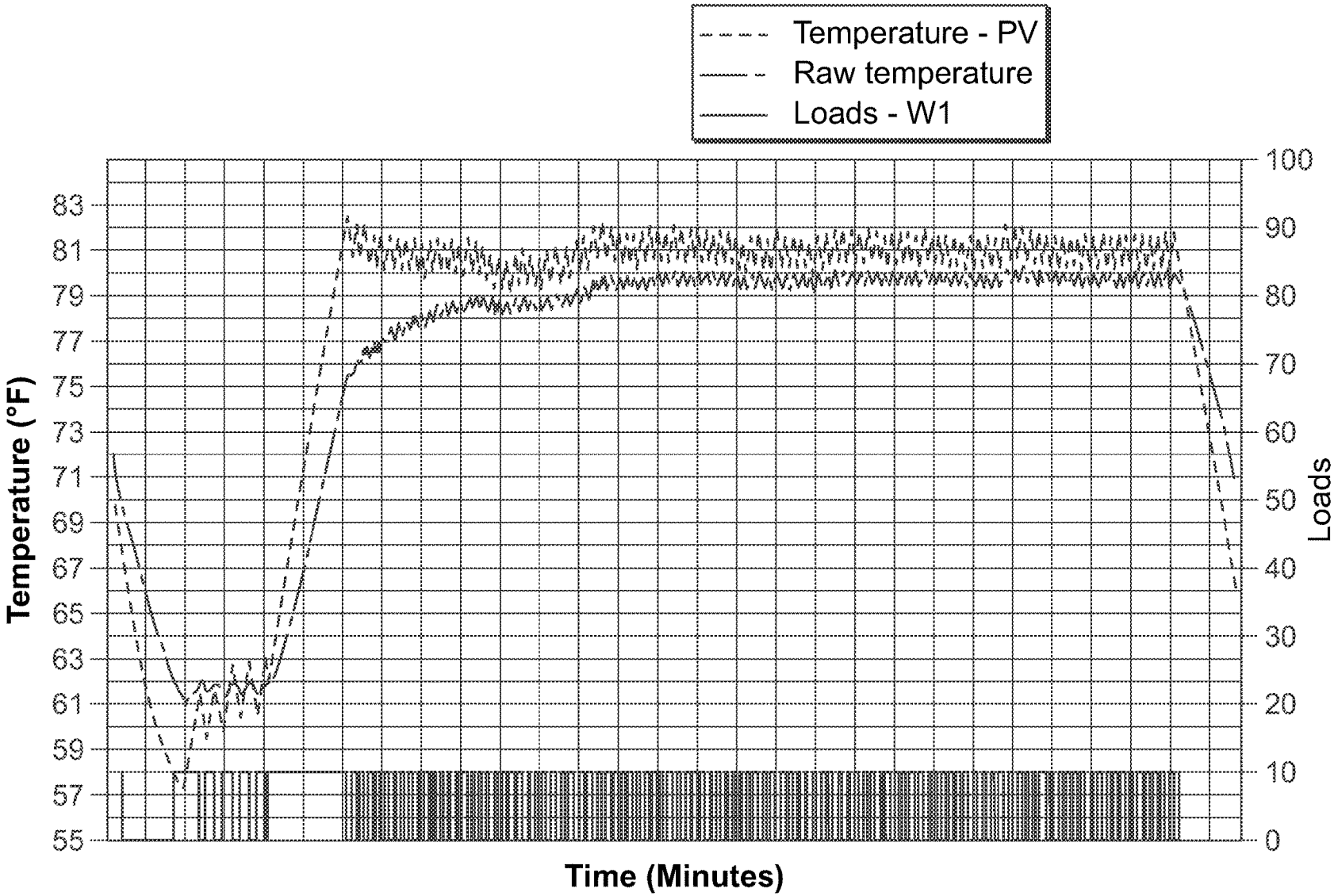
FIG. 6 is an exemplary line graph of chamber temperature and raw temperature (° F.) and first stage heat W1 loads versus time (minutes), and showing that raw temperature continues to increase for about an hour after the call for heat has been satisfied.

FIG. 6 is an exemplary line graph of chamber temperature and raw temperature (° F.) and first stage heat W1 loads versus time (minutes), wherein the heat mode setpoint was 80° F. with a ramp-up rate of 20° F. per hour and a ramp down rate of 20° F. per hour. As shown in FIG. 6, raw temperature continues to increase for about an hour after the call for heat has been satisfied.

Hardware thermal lag compensation may be removed or decremented in idle and ramp down modes. In the idle mode, the temperature is about equal to the setpoint. And if W1 is cycling, then hardware thermal lag compensation may be decremented every 18 seconds (or other suitable time interval greater or less than 18 seconds) during the idle mode. In the ramp down mode, the temperature is greater than the setpoint. In which case, hardware thermal lag compensation may be decremented every few seconds (or other suitable time interval greater or less than a few seconds) during the ramp down mode.

Figure 7A:
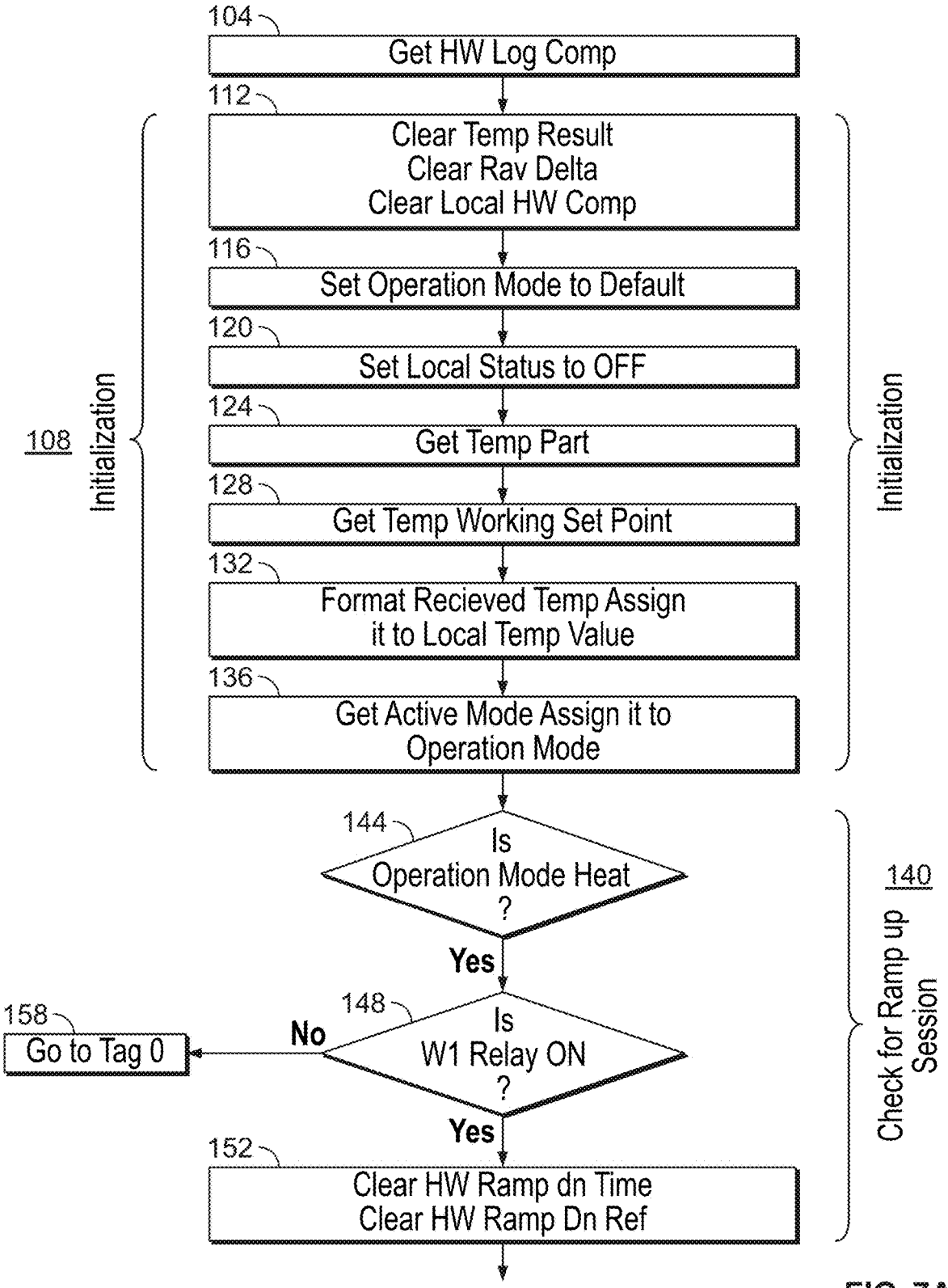
FIGS. 7A through 7G illustrate a flow chart of an exemplary method (e.g., firmware algorithm for a thermostat, etc.) for managing temperature overshoot according to an exemplary embodiment.

FIGS. 7A through 7G illustrate a flow chart of an exemplary method (e.g., firmware algorithm for a thermostat, etc.)

for managing temperature overshoot according to an exemplary embodiment. As shown in FIG. 7A, the method includes obtaining hardware lag compensation at 104 and initialization at 108.

For initialization 108, temperature result, raw temperature delta, and local hardware compensation are cleared at 112; operation mode is set to default at 116; location status is set to off at 120; temperature is obtained at 124; temperature working setpoint is obtained at 128; received temperature is formatted and assigned to local temperature value at 132; and active mode is obtained and assigned to operation mode at 136.

After initialization at 108, the method includes checking for a temperature ramp up session at 140. A determination is made at 144 as to whether the operation mode is heat. If it is determined at 144 that the operation mode is not heat, then the method stops. If it is determined at 144 that the operation mode is heat, then a determination is made at 148 as to whether the W1 (first stage heat) relay is ON at 148. If it is determined at 148 that the W1 relay is ON, then the hardware ramp down time and hardware ramp down reference are cleared at 152. But if it is determined at 148 that the W1 relay is not ON, then the method proceeds to tag 0 at 158 (FIG. 7F).

Figure 7B:
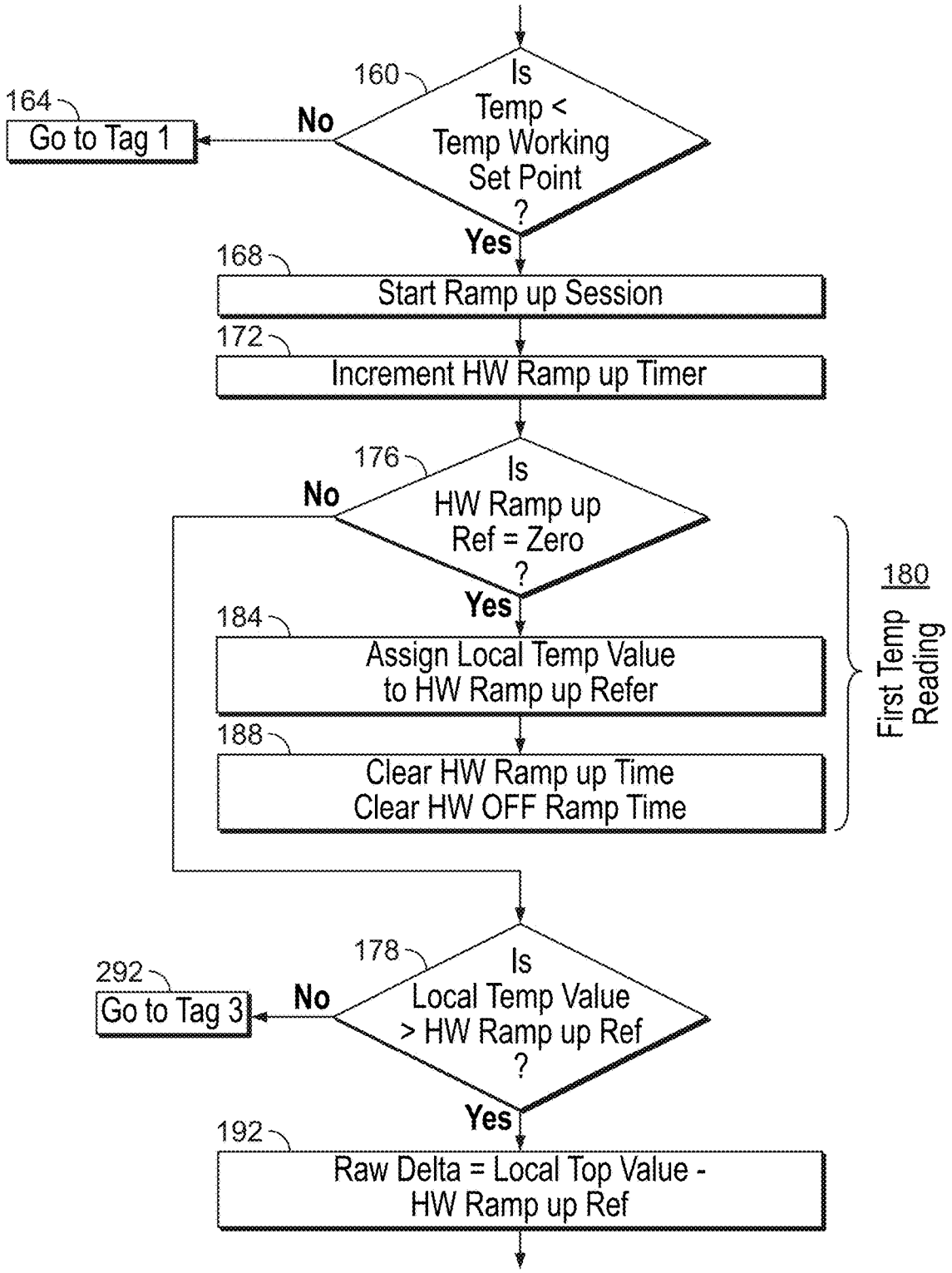

As shown in FIG. 7B, a determination is made at 160 whether temperature is less than temperature working setpoint. If it is determined at 160 that temperature is not less than temperature working setpoint, then the method proceeds to tag 1 at 164 (FIG. 7D). If it is determined at 160 that temperature is less than temperature working setpoint, then a ramp up session is started at 168 and a hardware (HW) ramp up timer is incremented at 172.

A determination is made at 176 as to whether hardware ramp up reference is equal to zero. If it is determined at 176 that hardware ramp up reference is not zero, then the method proceeds to 178. But if it is determined at 176 that hardware ramp up reference is zero, then a first temperature reading is obtained at 180. Local temperature value is assigned to hardware ramp up reference at 184, and hardware ramp up time and hardware off ramp time are cleared at 188.

A determination is made at 178 as to whether local temperature value is greater than hardware ramp up reference. If it is determined at 178 that local temperature value is not greater than hardware ramp up reference, then the method proceeds to tag 3 at 292 (FIG. 7G). If it is determined at 178 that local temperature value is greater than hardware ramp up reference, then raw temperature delta is determined or calculated at 192 by subtracting hardware ramp up reference from local temperature value.

Figure 7C:
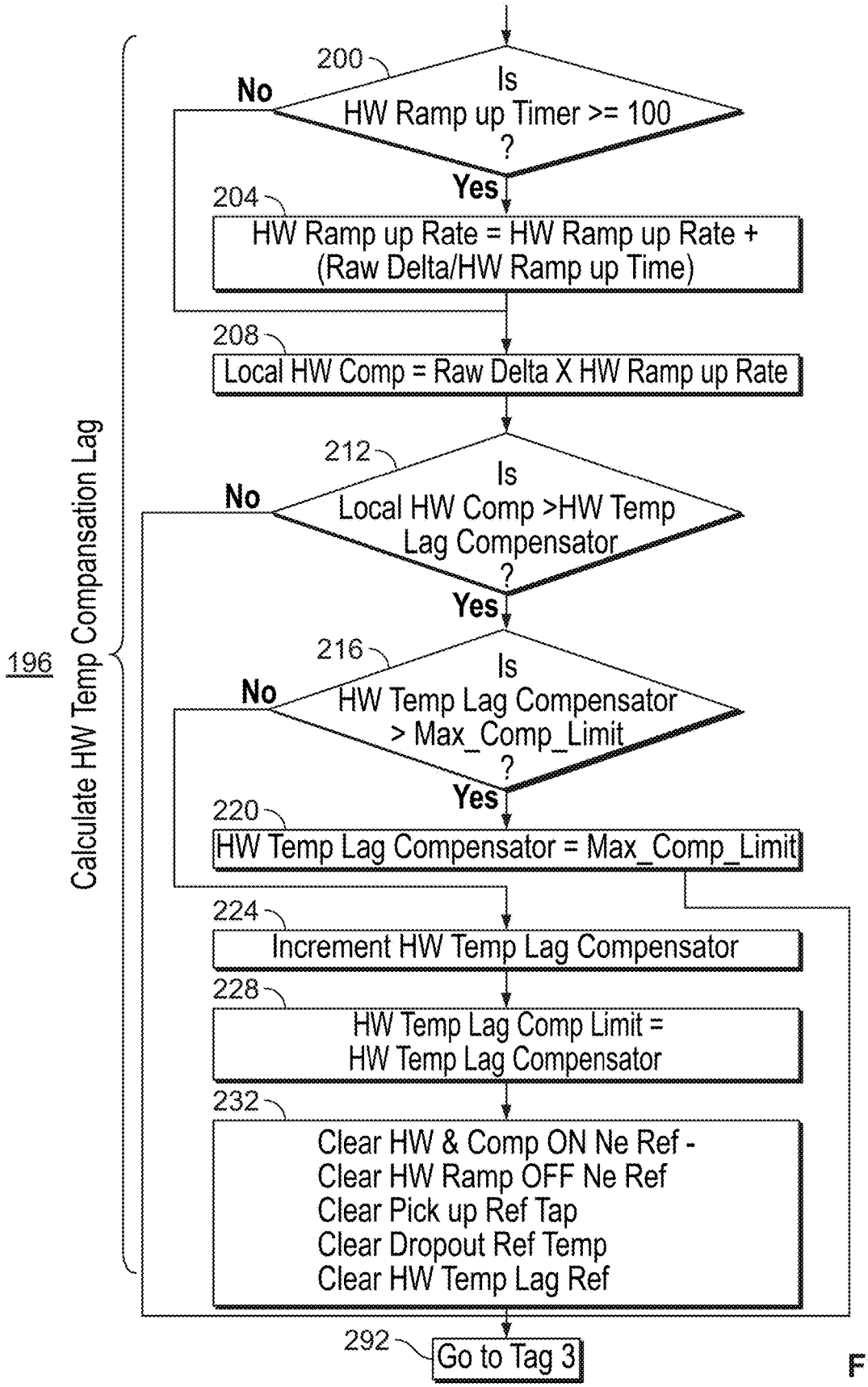
Figure 7D:
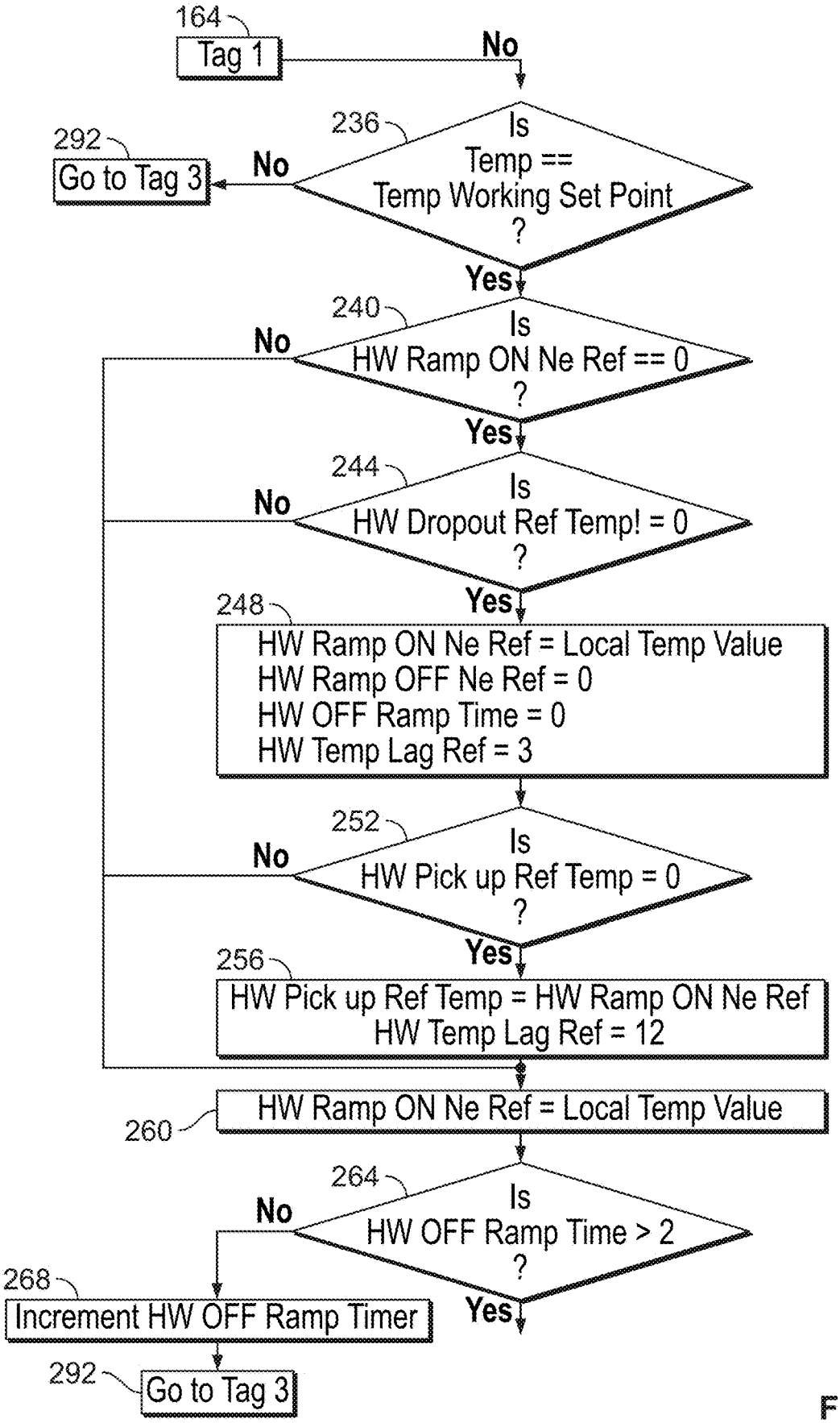

As shown in FIG. 7C, the method includes determining hardware temperature compensation lag at 196. A determination is made at 200 as to whether hardware ramp up timer is greater than or equal to 100 (or other predetermined value). If it is determined at 200 that hardware ramp up timer is greater than or equal to 100, then hardware ramp up rate is determined or calculated at 204 by adding the quotient of raw temperature delta divided by the hardware ramp up time to hardware ramp up rate.

At 208, local hardware compensation is determined or calculated by multiplying raw temperature delta times hardware ramp up rate. A determination is made at 212 whether local hardware compensation is greater than hardware temperature lag compensation. If it is determined at 212 that local hardware compensation is not greater than hardware temperature lag compensation, then the method proceeds to tag 3 at 292 (FIG. 7G). If it is determined at 212 that local hardware compensation is greater than hardware temperature lag compensation, then a determination is made at 216 whether hardware temperature lag compensation is greater than maximum compensation limit (or other predetermined value).

If it is determined at 216 that hardware temperature lag compensation is greater than maximum compensation limit (or other predetermined value), then at 220 the hardware temperature lag compensation is set to maximum compensation limit, and then the method proceeds to tag 3 at 292 (FIG. 7G). If it is determined at 216 that hardware temperature lag compensation is not greater than maximum compensation limit (or other predetermined value), hardware temperature lag compensation is incremented at 224. Hardware temperature compensation limit is set to hardware temperature lag compensation at 228. And, at 232, hardware ramp on NE reference, hardware ramp down NE reference, hardware pickup reference temperature, hardware dropout reference temperature, and hardware temperature lag reference are cleared. NE is a reference to neutral, which is the condition where temperature and setpoint are equal and the W1 is cycling after the RAMP UP period is ended. After 232, the method proceeds to tag 3 at 292 (FIG. 7G).

After tag 1 (FIG. 7D), a determination is made at 236 whether the temperature is equal to temperature working setpoint. If it is determined at 236 that temperature is not equal to temperature working setpoint, then the method proceeds to tag 3 at 292 (FIG. 7G). If it is determined at 236 that temperature is equal to temperature working setpoint, then a determination is made at 240 whether hardware ramp on NE reference is equal to zero.

If it is determined at 240 that hardware ramp on NE reference is not zero, then the method proceeds to 260. If it is determined at 240 that hardware ramp on NE reference is zero, then a determination is made at 244 whether hardware dropout reference temperature is equal to zero.

If it is determined at 244 that hardware dropout reference temperature is not zero, then the method proceeds to 260. If it is determined at 244 that hardware dropout reference temperature is zero, then at 248 hardware ramp on NE reference is set to local temperature value, hardware ramp off NE reference is set to zero, hardware off ramp time is set to zero, and hardware temperature lag reference is set to 3 (or other predetermined value).

A determination is made at 252 as to whether hardware pickup reference temperature is equal to zero. If it is determined at 252 that hardware pickup reference temperature is not zero, then the method proceeds to 260. If it is determined at 252 that hardware pickup reference temperature is zero, then at 256 hardware pickup reference temperature is set to hardware ramp on NE reference, and hardware temperature lag reference is set to 12 (or other predetermined value).

At 260, hardware ramp on NE reference is set to local temperature value. A determination is made at 264 as to whether hardware off ramp time is greater than 2 (or other predetermined value). If it is determined at 264 that hardware off ramp time is not greater than 2, then hardware off ramp time is incremented at 268, and then the method proceeds to tag 3 at 292 (FIG. 7G). If it is determined at 264 that hardware off ramp time is greater than 2, then hardware off ramp timer is cleared at 272 (FIG. 7E).

Figure 7E:
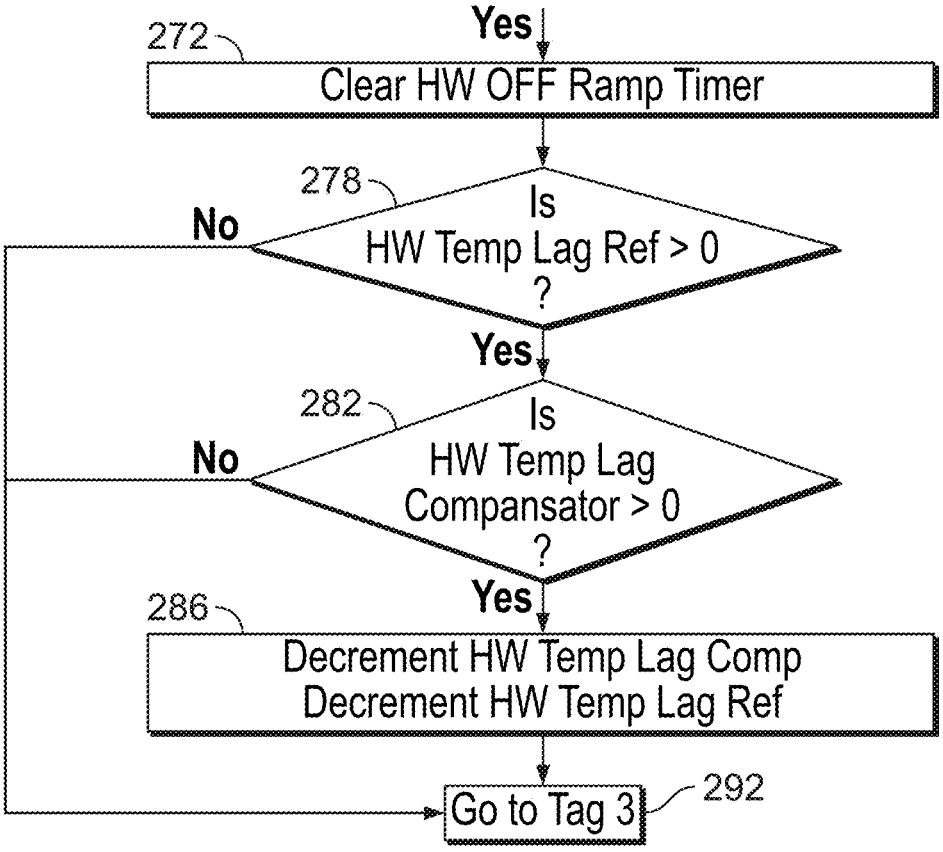
Figure 7F:
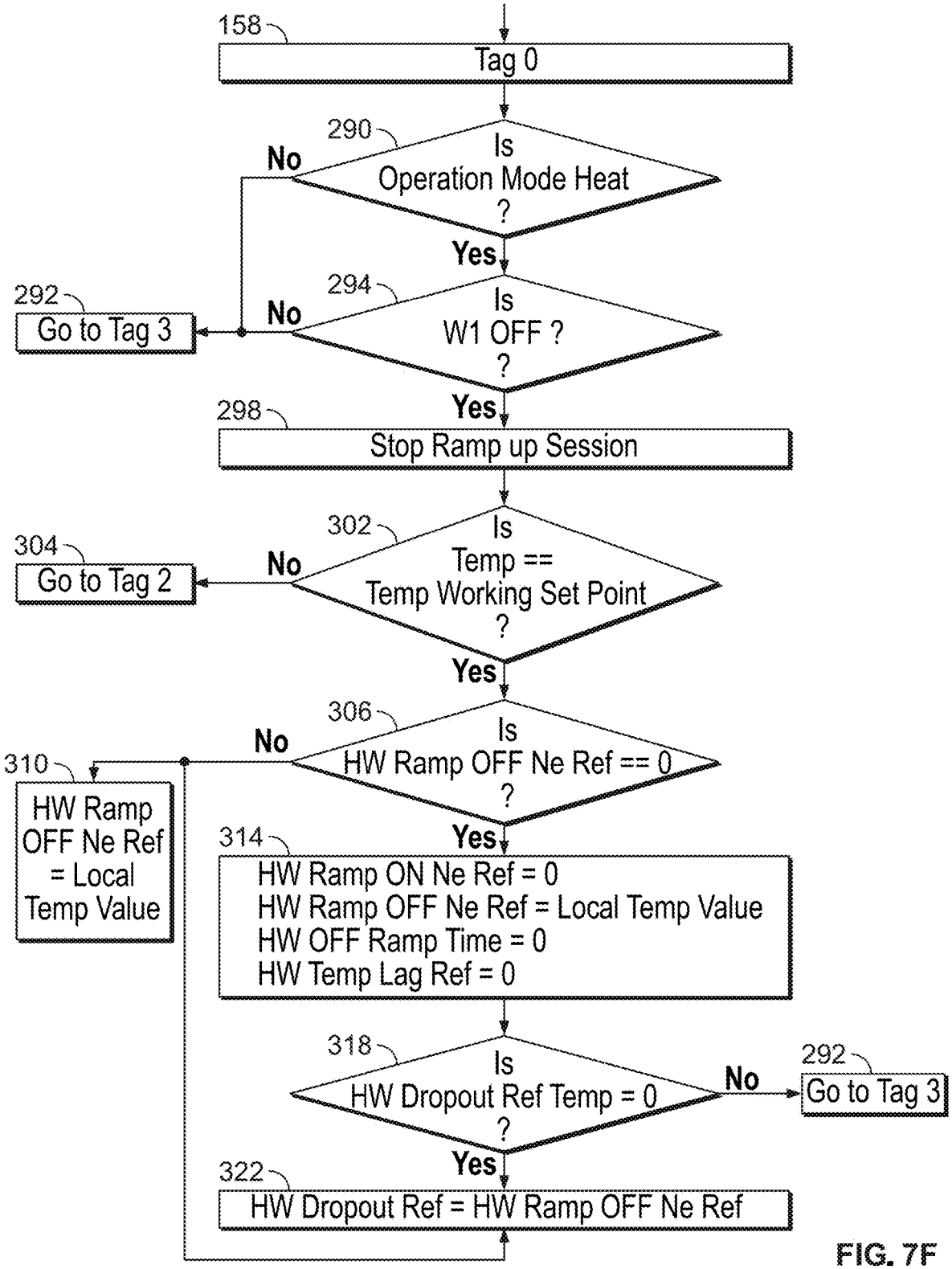
Figure 7G:
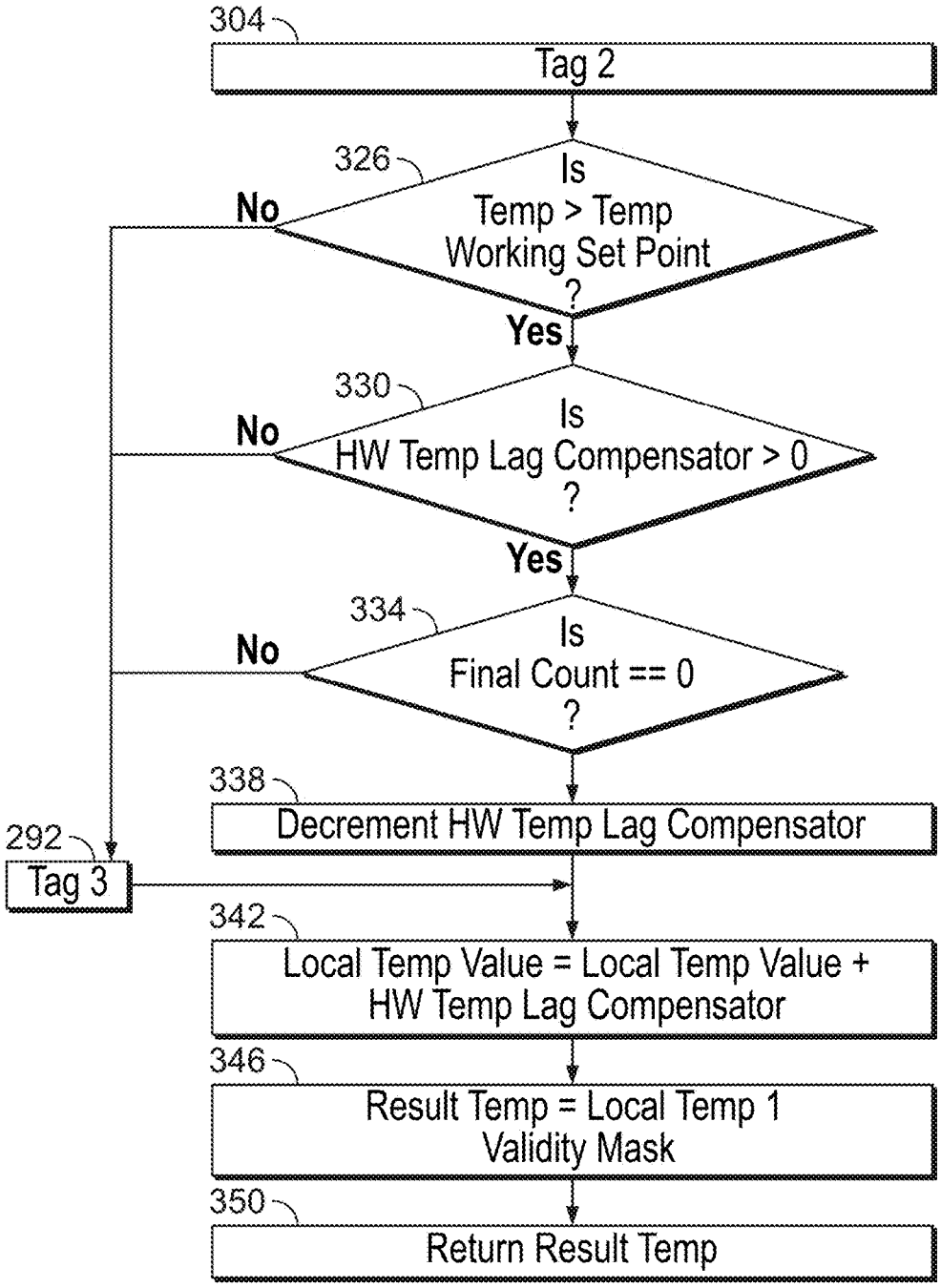

As shown in FIG. 7E, a determination is made at 278 as to whether hardware temperature lag reference is greater than zero. If it is determined at 278 that hardware temperature lag reference is not greater than zero, then the method proceeds to tag 3 at 292 (FIG. 7G). If it is determined at 278 that hardware temperature lag reference is greater than zero, then a determination is made at 282 as to whether hardware temperature lag compensation is greater than zero.

If it is determined at 282 that hardware temperature lag compensation is not greater than zero, then the method proceeds to tag 3 at 292 (FIG. 7G). If it is determined at 282 that hardware temperature lag compensation is greater than zero, then at 286 hardware temperature lag compensation and hardware temperature lag reference are decremented.

As shown in FIG. 7F, a determination is made at 290 whether the operation mode is heat. If it is determined at 290 that the operation mode is not heat, then the method proceeds to tag 3 at 292 (FIG. 7G).

If it is determined at 290 that the operation mode is heat, then a determination is made at 294 whether the W1 (first stage heat) relay is OFF. If it is determined at 294 that the W1 relay is not OFF, then the method proceeds to tag 3 at 292 (FIG. 7G). If it is determined at 294 that the W1 relay is OFF, then a stop ramp up session is started at 298.

A determination is made at 302 as to whether temperature is equal to temperature working set point. If it is determined at 302 that temperature is not equal to temperature working set point, then the method proceeds to tag 2 at 304 (FIG. 7G). If it is determined at 302 that temperature is equal to temperature working set point, a determination is made at 306 as to whether hardware ramp off (NE) reference is equal to zero.

If it is determined at 306 that hardware ramp off (NE) reference is not equal to zero, then hardware ramp off (NE) reference is set to be equal to local temperature value at 310. If it is determined at 306 that hardware ramp off (NE) reference is equal to zero, then at 314 hardware ramp on NE reference is set to zero, hardware ramp off NE reference is set to local temperature value, hardware off ramp time is set to zero, and hardware temperature lag reference is set to zero.

A determination is made at 318 as to whether hardware dropout reference temperature is zero. If it is determined at 318 that hardware dropout reference temperature is not zero, then the method proceeds to tag 3 at 292 (FIG. 7G). If it is determined at 318 that hardware dropout reference temperature is zero, then hardware dropout reference temperature is set to equal hardware ramp off NE reference at 322.

After tag 2 (FIG. 7G), a determination is made at 326 as to whether temperature is greater than temperature working set point. If it is determined at 326 that temperature is not greater than temperature working set point, then the method proceeds to tag 3 at 292. If it is determined at 326 that temperature is greater than temperature working set point, a determination is made at 330 as to whether hardware temperature lag compensation is greater than zero.

If it is determined at 330 that hardware temperature lag compensation is not greater than zero, then the method proceeds to tag 3 at 292. If it is determined at 330 that hardware temperature lag compensation is greater than zero, then a determination is made at 334 as to whether final count is equal to zero. If it is determined at 334 that final count is not zero, then the method proceeds to tag 3 at 292. If it is determined at 334 that final count is zero, then hardware temperature lag compensation is decremented at 338.

At 342, hardware temperature lag compensation is added to local temperature value. At 346, result temperature is set to equal local temperature validated (validity mask) and returned at 350.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for managing temperature overshoot, the method comprising:

determining a temperature delta between two sensor temperatures reported for a space at predetermined time intervals;

determining a temperature rate of change by dividing the temperature delta with a time period that elapsed between the two sensor temperatures;

determining a compensation by multiplying the temperature delta and the temperature rate of change;

determining a compensated temperature by adding the compensation to a sensor temperature reported for the space; and using a controller and the compensated temperature to control operation of a heating system for the space.

2. The method of claim 1, wherein:

the heating system comprises an HVAC system;

the controller comprises a thermostat; and using a controller and the compensated temperature to control operation of a heating system for the space comprises using the thermostat and the compensated temperature to control a heating mode of operation of the HVAC system.

3. The method of claim 2, wherein the method is initiated when:

the HVAC system is in the heating mode of operation;

the sensor temperature reported for the space is lower than a temperature setpoint of the thermostat; and the thermostat is calling for heat and first stage heat has been energized for at least a predetermined amount of time.

4. The method of claim 2, wherein the method includes using a thermistor of the thermostat to obtain sensor temperature for the space at the predetermined time intervals.

5. The method of claim 1, wherein the method includes using a temperature sensor to obtain sensor temperature for the space at the predetermined time intervals, the temperature sensor having a response to temperature change less than a rate of change in heating of the space by the heating system.

6. The method of claim 1, wherein the method includes waiting a predetermined amount of time before determining a first temperature rate of change, and thereafter recalculating the temperature rate of change for the space at the predetermined time intervals.

7. The method of claim 1, wherein the method includes using the controller and the compensated temperature to control operation of the heating system for the space such that the temperature overshoot is 1° F. or less for any temperature rate of change in heating of the space by the heating system.

8. The method of claim 1, wherein the method includes using the controller and the compensated temperature to control operation of the heating system for the space such that the temperature overshoot is 1° F. or less including when the heating system is heating the space at a temperature rate of change of at least 20° F. per hour or more.

9. The method of claim 1, wherein using a controller and the compensated temperature to control operation of a heating system for the space comprises using a thermostat and the compensated temperature to manage temperature overshoot via thermostat-based temperature-driven ramp-up compensation.

10. The method of claim 1, wherein the method includes using the controller and the compensated temperature to control a heating mode of operation of the heating system for ramp-up compensation.

11. The method of claim 1, wherein the method includes:

starting a timer and obtaining a first sensor reference temperature for the space when there is a call for heat and first stage heat is energized;

waiting a predetermined amount of a time while the first stage heat is energized and then obtaining a second sensor temperature for the space;

determining the temperature delta between the second sensor temperature that was recently obtained and the first sensor reference temperature that was obtained when the first stage heat was energized; and for temperature ramp up, determining the temperature rate of change by dividing the temperature delta with the time that has elapsed between when the first stage heat was energized and the first sensor reference temperature was obtained for the space and when the most recent second sensor temperature was obtained for the space.

12. The method of claim 1, wherein:

the temperature delta is the difference between a first sensor reference temperature for the space when there is a call for heat and first stage heat is energized and a second sensor temperature for the space obtained a predetermined amount of a time while the first stage heat is energized;

the temperature rate of change is the quotient of the temperature delta divided by a time period that elapsed between when the first stage heat was energized and the first sensor reference temperature was obtained for the space and when the most recent second sensor temperature was obtained for the space;

the compensation is the product of the temperature delta and the temperature rate of change; and the compensated temperature is the sum of the compensation and the most recent second sensor temperature.

13. The method of claim 1, wherein the method includes providing a power up default value for the temperature rate of change upon power up of the heating system.

14. A thermostat for an HVAC system configured to perform the method of claim 1.

15. A thermostat-based temperature-driven compensation method for managing temperature overshoot of a space when heated by an HVAC system, the method comprising:

determining a temperature delta between two sensor temperatures reported for a space at predetermined time intervals;

determining a temperature rate of change by dividing the temperature delta with a time period that elapsed between the two sensor temperatures;

determining a compensation by multiplying the temperature delta and the temperature rate of change;

determining a compensated temperature by adding the compensation to a sensor temperature reported for the space; and using a thermostat and the compensated temperature to control a heating mode of operation of the HVAC system such that the temperature overshoot is 5° F. or less.

16. The method of claim 15, wherein the method includes using the thermostat and the compensated temperature to control the heating mode of operation of the HVAC system such that the temperature overshoot is 1° F. or less including when the HVAC system is heating the space at a temperature rate of change of at least 20° F. per hour or more.

17. The method of claim 15, wherein:

the temperature delta is the difference between a first sensor reference temperature for the space when there is a call for heat and first stage heat is energized and a second sensor temperature for the space obtained a predetermined amount of a time while the first stage heat is energized;

the temperature rate of change is the quotient of the temperature delta divided by a time period that elapsed between when the first stage heat was energized and the first sensor reference temperature was obtained for the space and when the most recent second sensor temperature was obtained for the space;

the compensation is the product of the temperature delta and the temperature rate of change; and the compensated temperature is the sum of the compensation and the most recent sensor temperature.

18. A thermostat configured for controlling operation of an HVAC system, the thermostat comprising a processor and a temperature sensor configured to be operable for obtaining sensor temperature of a space in which the thermostat is installed, the processor configured to:

determine a temperature delta between two sensor temperatures from the temperature sensor for the space at predetermined time intervals;

determine a temperature rate of change by dividing the temperature delta with a time period that elapsed between the two sensor temperatures;

determine a compensation by multiplying the temperature delta and the temperature rate of change; and determine a compensated temperature by adding the compensation to a sensor temperature obtained from the temperature sensor for the space;

whereby the thermostat is configured to be operable for using the compensated temperature for controlling a heating mode of operation of the HVAC system such that the temperature overshoot is 5° F. or less.

19. The thermostat of claim 18, wherein the thermostat is configured to be operable for using the compensated temperature for controlling the heating mode of operation of the HVAC system such that the temperature overshoot is 1° F. or less including when the HVAC system is heating the space at a temperature rate of change of at least 20° F. per hour or more.

20. The thermostat of claim 18, wherein:

the temperature delta is the difference between a first sensor reference temperature for the space when there is a call for heat and first stage heat is energized and a second sensor temperature for the space obtained a predetermined amount of a time while the first stage heat is energized;

the temperature rate of change is the quotient of the temperature delta divided by a time period that elapsed between when the first stage heat was energized and the first sensor reference temperature was obtained for the space and when the most recent second sensor temperature was obtained for the space;

the compensation is the product of the temperature delta and the temperature rate of change; and the compensated temperature is the sum of the compensation and the most recent sensor temperature.

* * * * *